United States Patent [19]

Tucci

[11] 4,144,633

[45] Mar. 20, 1979

[54] PORTABLE APPARATUS FOR CONNECTING WIRES IN CONNECTORS

[75] Inventor: John J. Tucci, Winston-Salem, N.C.

[73] Assignee: AMP Incorporated, Harrisburg, Pa.

[21] Appl. No.: 874,285

[22] Filed: Feb. 1, 1978

[51] Int. Cl.[2] ..... H01R 43/04

[52] U.S. Cl. ..... 29/566.3; 29/751; 29/753

[58] Field of Search ..... 29/751, 753, 760, 749, 29/566.3, 566.4

[56] References Cited

U.S. PATENT DOCUMENTS

| | | | |
|---|---|---|---|
| 3,866,296 | 2/1975 | Tucci | 29/749 |
| 4,048,710 | 9/1977 | Nijman | 29/566.4 |

*Primary Examiner*—Carl E. Hall
*Attorney, Agent, or Firm*—Gerald K. Kita

[57] ABSTRACT

The disclosure relates to connecting multiple wires into connectors using a tool having a platen on which is incorporated a connector, a comb, and a lever actuated insertion tool for inserting wires one at a time into contacts of the connector by indexing the tool to successive wire insertion positions or, alternatively, freely sliding the tool to any one of the positions whereat a wire is positioned against an insertion blade of the tool prior to and during movement of the blade and wire together toward the connector in the act of inserting the wire.

5 Claims, 15 Drawing Figures

40
32
1
6
36
24
38
22
2
10
142

110
110
98
94
100
96

10
16
18
20
38
42
44
46
36
6
14
7
33
112
32
114
124
34
68
70
40
28
24
22
30
26
27

PORTABLE APPARATUS FOR CONNECTING WIRES IN CONNECTORS

BACKGROUND

The present invention relates to apparatus for inserting small diameter insulated conductors into a row of contacts contained in an insulative electrical connector housing. Related apparatus is described in U.S. Pat. Nos. 3,864,802 and 3,866,296. In each patent is disclosed apparatus upon which a connector housing is mounted. The housing includes a row of electrical contacts into which insulated wires are to be inserted and electrically connected to the contacts. First the wires are interlayed between teeth of a first stationery comb. The wires are straightened, and then bridged across to another comb and interlaid between the teeth. The straightened wires are held by the multiple combs in proper orientation for insertion into the contacts of the connector. A suitably tailored ram impinges the wires and inserts the wires into the contacts.

The above described apparatus is suitable for work bench use. However, it is too cumbersome as a portable tool, in cramped spaces or elevated heights or at awkward orientations with respect to horizontal. For example, there is a requirement to terminate telephone cables into a large number of connectors which are mounted in a vertical panel of a size remindful of a room partition. It is necessary to bring the cables in close proximity with the selected connector locations in the panel, so that the cable wires can be connected in the connectors without successive slack in the cable and without the possibility of trimming the wires too short and therefore unable to reach the connector locations on the panel surface. There is a need for a tool capable of connecting the wires in the connectors at elevated heights and awkward orientations. In all respects, the tool must be portable and usable by a workman in cramped quarters.

SUMMARY OF THE INVENTION

The apparatus according to the invention relates to a portable tool for inserting wires into a multiple contact connector. The wires are inserted without severing. Alternatively, they can be severed at the connector. In use, the connector is mounted to a platen of the tool and wires are interlaid between the teeth of a single comb. A lever actuated inserter blade is pivotally secured to a shaft parallel to the row of contacts in the connector. The inserter blade is indexed along the shaft successively in alignment with each contact. Each wire in turn is manually positioned over a contact and in alignment with the inserter blade, whereby upon manually pivoting the lever together with the wire, the blade will forcibly insert a wire within a corresponding contact. The inserter also may be made freely slidable along the shaft to any position without having to hesitate successively at each contact position. A fixed cutter blade may be mounted on the platen adjacent to the row of contacts. When the inserter blade engages a wire and is pivoted to insert a wire into a contact, the inserter blade will cooperate with the cutter blade in a scissoring action to sever the wire. The cutter blade is provided with a comb to aid in alignment of a wire prior to severing and insertion thereof into a contact.

Absent the cutter blade only one comb is required for initially positioning a wire. More specifically, the inserter itself includes a groove portion to assist positioning the wire against the inserter blade prior to and during movement of the blade and wire together toward the connector in the act of inserting the wire. The tool is lightweight and portable because of the tool simplicity and the elimination of parts, such as by avoiding duplicate combs and by eliminating a heavy arbor press with concomitant actuation and return mechanisms. The inserter blade may be latched against the comb when positioned out of the way, enabling the tool to be used in any awkward orientation. For example, the vertical telephone panel as described above requires the tool of the present invention to be temporarily attached to the panel while wire connections are made. The tool is movable and attachable at elevated heights for use in vertical positions or in cramped quarters where use of existing insertion tools is impractical.

OBJECTS

An object of the present invention is to provide a portable tool for connecting multiple wires to electrical contacts in an electrical connector.

Another object is to provide a tool which connects wires into a multi contact connector using a lever actuated inserter blade having means for positioning the wire against the blade prior to and during movement of the blade and the wire together toward the connector in the act of inserting the wire.

Another object is to provide a portable tool of the type which connects multiple wires into a multi contact connector using a lever actuated inserter blade which may be indexed to successive wire insertion positions or alternatively freely slidable to any of the positions, and which can be latched out of the way so the tool may be used in vertical or other awkward orientations.

Other objects and advantages of the present invention will become apparent from the following detailed description taken in conjunction with the drawings.

DRAWINGS

Figure 1:
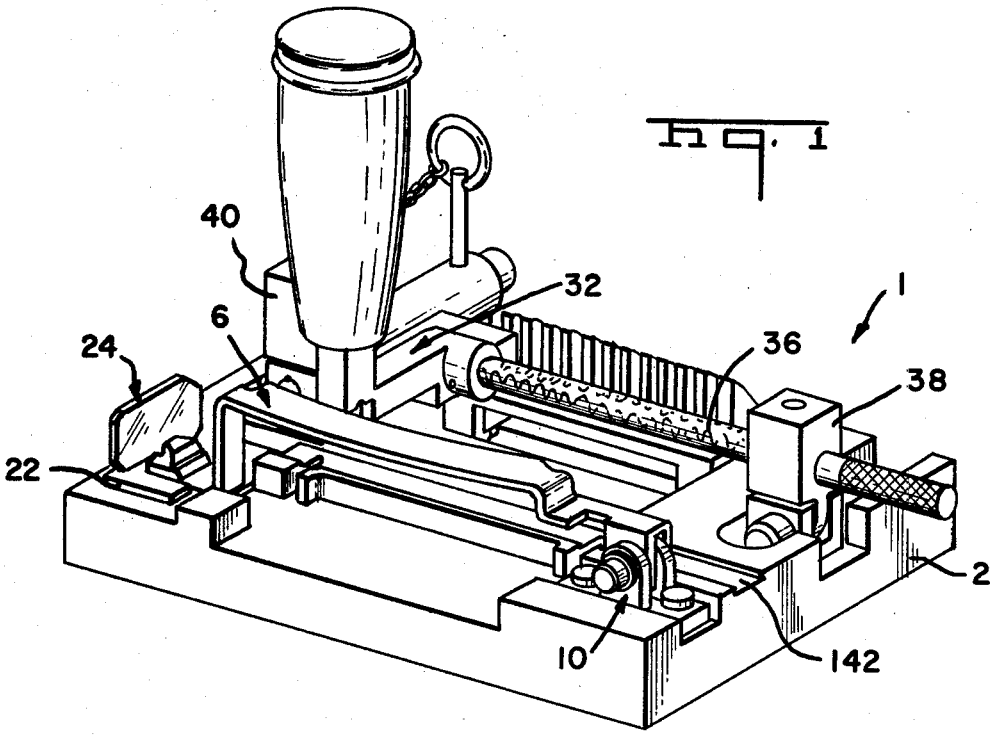
FIG. 1 is an enlarged fragmentary perspective of a tool according to the present invention.
Figure 3:
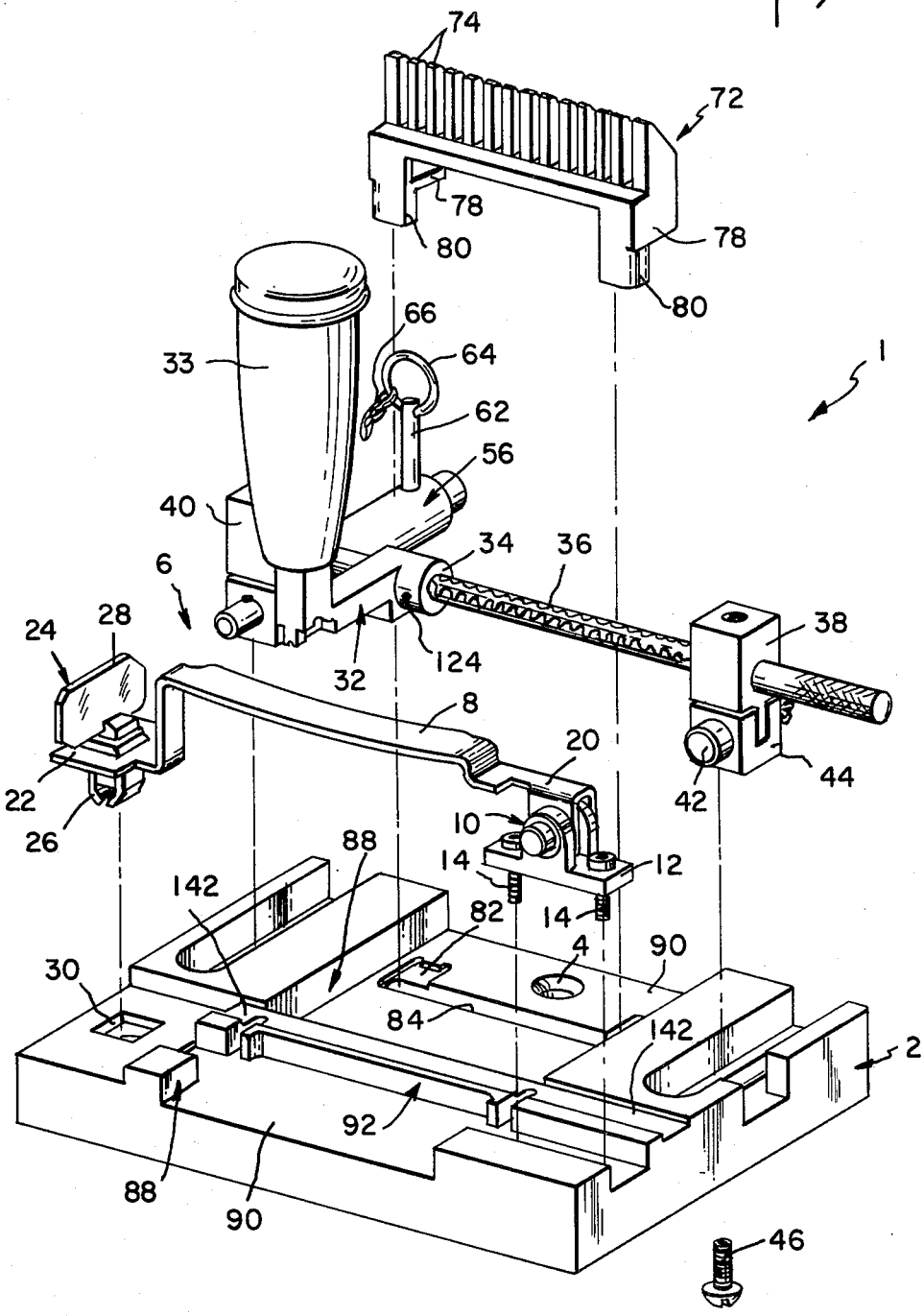
FIG. 3 is an enlarged perspective with parts exploded illustrating the details of the apparatus shown in FIG. 1.
Figures 5, 6, 7:
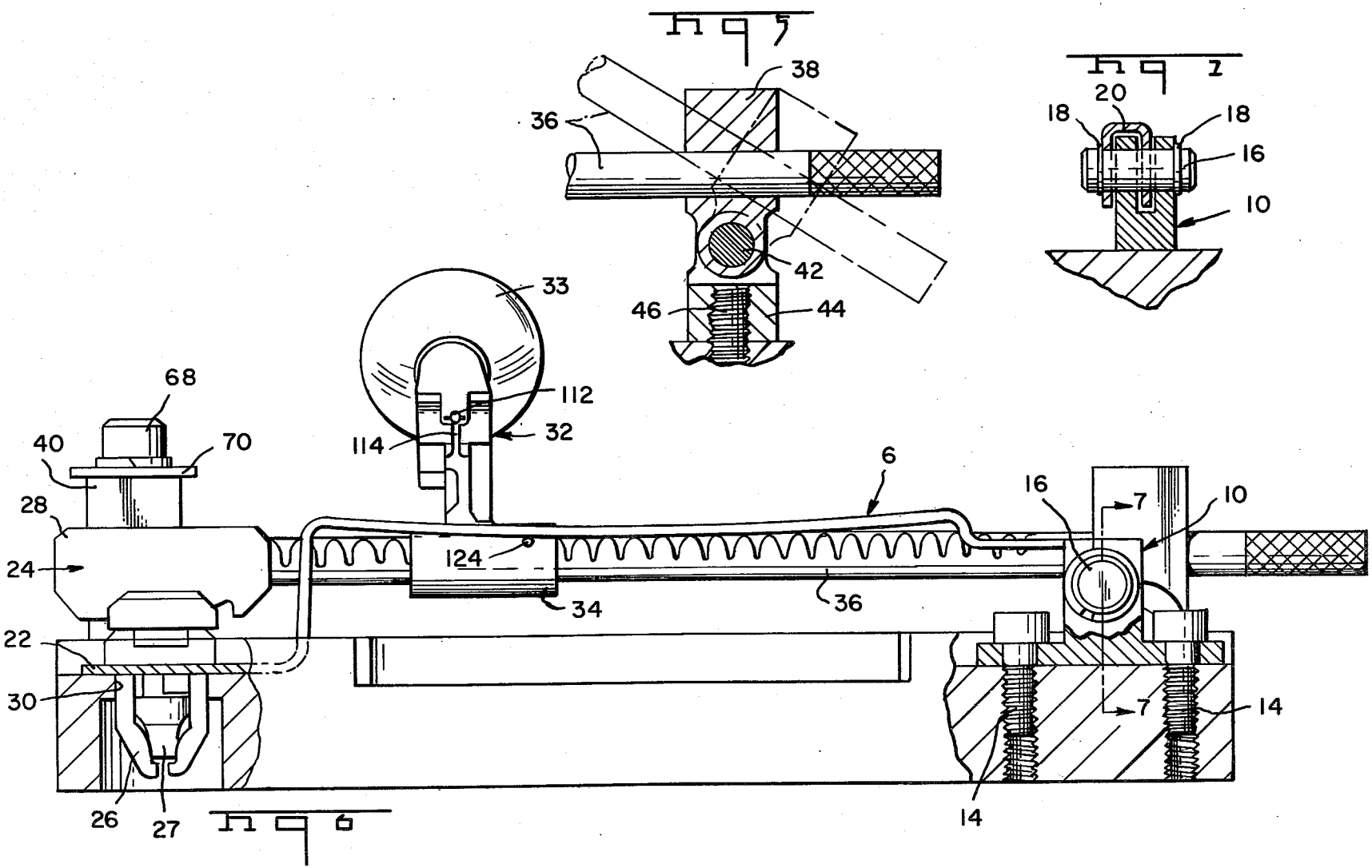
FIG. 5 is an enlarged fragmentary section taken along the line 5—5 of FIG. 4.
FIG. 6 is an enlarged side elevation of the apparatus shown in FIGS. 1 and 4 with parts broken away and with parts in section to illustrate the detail thereof.
FIG. 7 is an enlarged fragmentary section taken generally along the lines 7—7 of FIG. 6.

With more particular reference to the drawings, there is shown in FIGS. 1 and 3 a preferred embodiment of an apparatus according to the present invention for inserting and connecting small diameter insulated conductors into a row of contacts contained in an insulative electrical connector housing. The apparatus includes a base 2 which forms a platen on which may be mounted an electrical connector having a row of contacts such as the connector described in U.S. Pat. No. 3,760,335. The base 2 includes an aperture 4 therein which is useful for securing the base to a surface such as a vertical panel to which a plurality of electrical connectors are mounted. The apparatus includes a leaf spring clamp generally indicated at 6 having an elongate central portion 8 pivotally secured at one end to a clevis shown generally at 10 and including a base portion 12 secured by fasteners 14 to the platen 2. FIG. 7 shows the clevis 10 as having a pivot pin 16 therein secured in place by snap rings 18. The end 20 of the leaf spring 6 is formed into an inverted U configuration and is pivotally secured to the pin 16. The other end of the spring 6 is shown generally in FIGS. 1 and 3 as being formed into a generally rectangular flat base portion 22. The base portion 22 carried therein an expansible fastener indicated generally at 24 having an expansible and contractable chuck portion 26 actuated by rotating a central plug 27. The plug 27 is rotated by a hand operated key 28. In use, the connector is placed on the platen and overlaid by the spring clamp. The chuck 26 in its contracted configuration is received in an aperture 30 is a base 2. The key 28 is rotated by hand to expand the chuck 26 and within the aperture 30 and thereby lock the base 22 onto the platen. The latching device is known by the Tradename "NYLATCH" from the Hartwell Corporation, 900 S. Richfield Road, Placentia, Calif.

Figure 8:
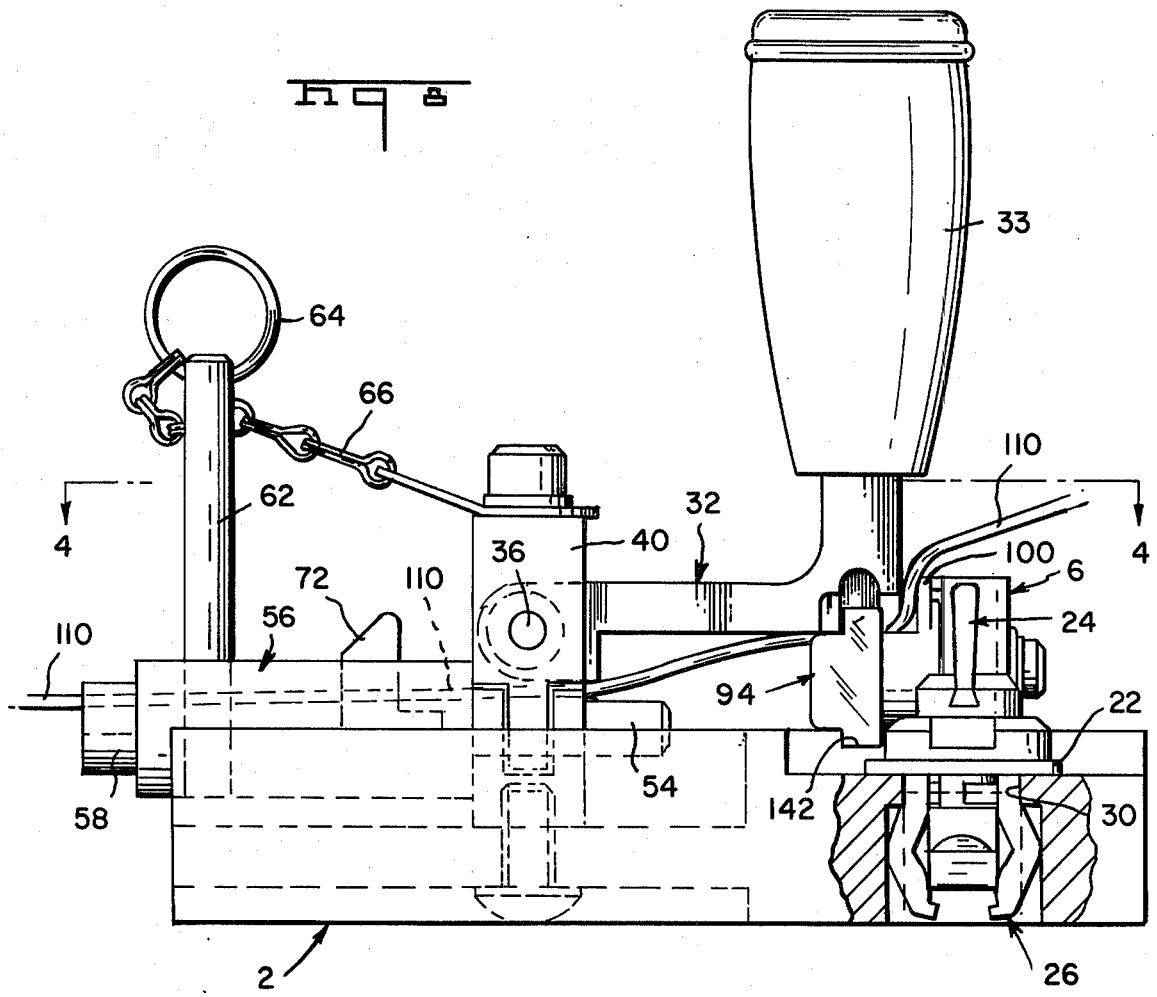
FIG. 8 is an enlarged end elevation of the apparatus shown in FIGS. 1 and 4 with parts broken away and parts in section to illustrate the details thereof, and further illustrating insertion of a wire into a contact of an electrical connector.
Figure 9:
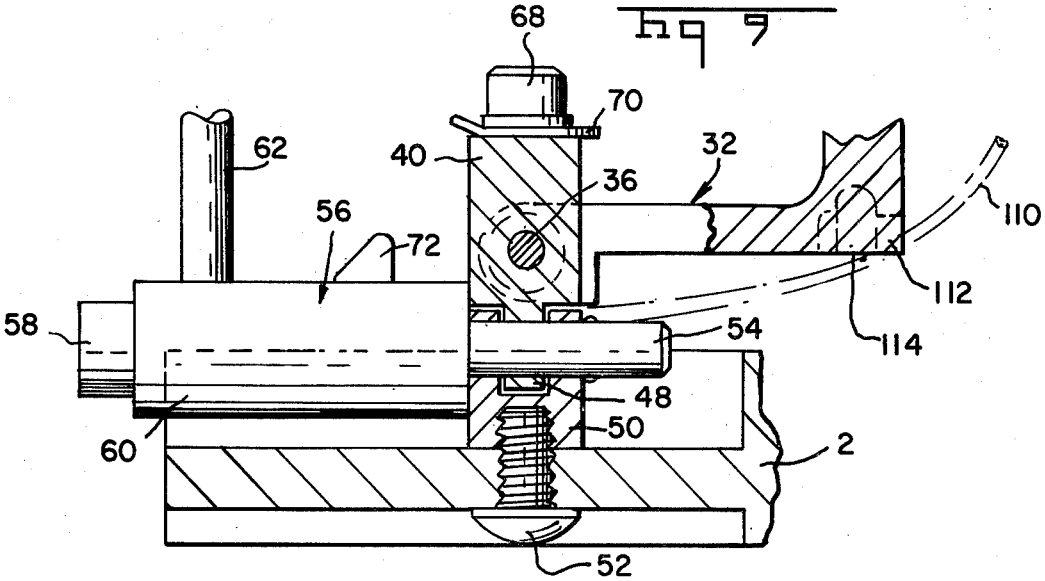
FIG. 9 is a fragmentary elevation with parts in section similar to the elevation shown in FIG. 8.

Yet with reference to FIGS. 1 and 3, the device is provided with a lever actuated inserter shown generally at 32 pivotally mounted at one end 34 to an elongated cylindrical shaft 36. The shaft 36 is mounted to the platen 2 by a pair of mounting blocks 38 and 40. As shown in FIG. 5 taken in conjunction with FIGS. 1 and 3, the block 38 is pivotally connected to a pin 42 carried by a clevis 44 mountable to the platen 2 and secured thereto by a fastener 46. The mounting block 40 is more particularly shown in FIGS. 4, 8, and 9. The block 40 includes a depending eye portion 48 received in a clevis 50 mounted to the platen 2 by a fastener 52. The eye 48 of the clevis 50 is secured by a cylindrical pin 54 of a plunger actuated latching device 56. More particularly, the device 56 is the type whereby a plunger shown at 58 in FIG. 9 is manually depressed into an outer casing 60, whereby projecting ball detents 61 projecting from the pin 54 thereby become retracted into the pin. Such a device is known by the tradename "Lockwell", manufactured by the Hartwell Corporation whose address is specified above. Latching device 56 is provided with a projecting post 62 having a ring 64. A chain section 66 connects the ring 64 with the mounting block 40. A fastener 68 passes through an end link 70 of the chain 66 securing the same to the block 40. As a result, when the latching device 56 is removed from the clevis 50, the chain 66 will prevent inadvertant loss thereof.

Figure 10:
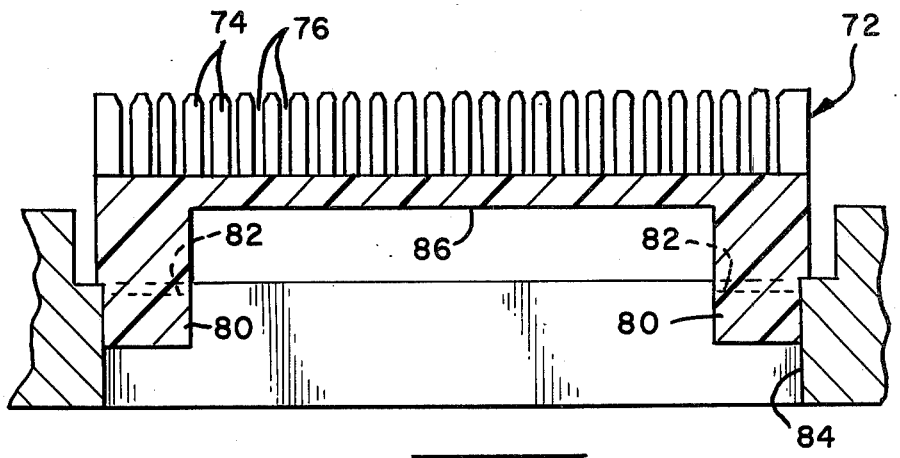
FIG. 10 is an enlarged fragmentary elevation in section taken along the line 10—10 of FIG. 4 illustrating in detail the removable comb.

To complete the assembly, reference is made to FIGS. 3 and 10 which illustrate an elongated comb shown generally at 72 having a row of aligned upstanding teeth, some of which are shown at 74. The teeth are spaced apart, with the spaces 76 therebetween having widths sufficient to receive corresponding individual wires interlaid between adjacent teeth. The comb is provided with a pair of feet 78 having depending projections 80. The feet 78 rest against the bottom of corresponding recesses 82 provided in the platen 2. The projections 80 are press fit into a slot 84 at opposite ends thereof whereby the comb 72 is mounted to the platen. As shown more particularly in FIG. 10, the comb is undercut at 86 to provide a relatively broad wire-receiving clearance defined between the comb and the platen 2.

Figure 4:
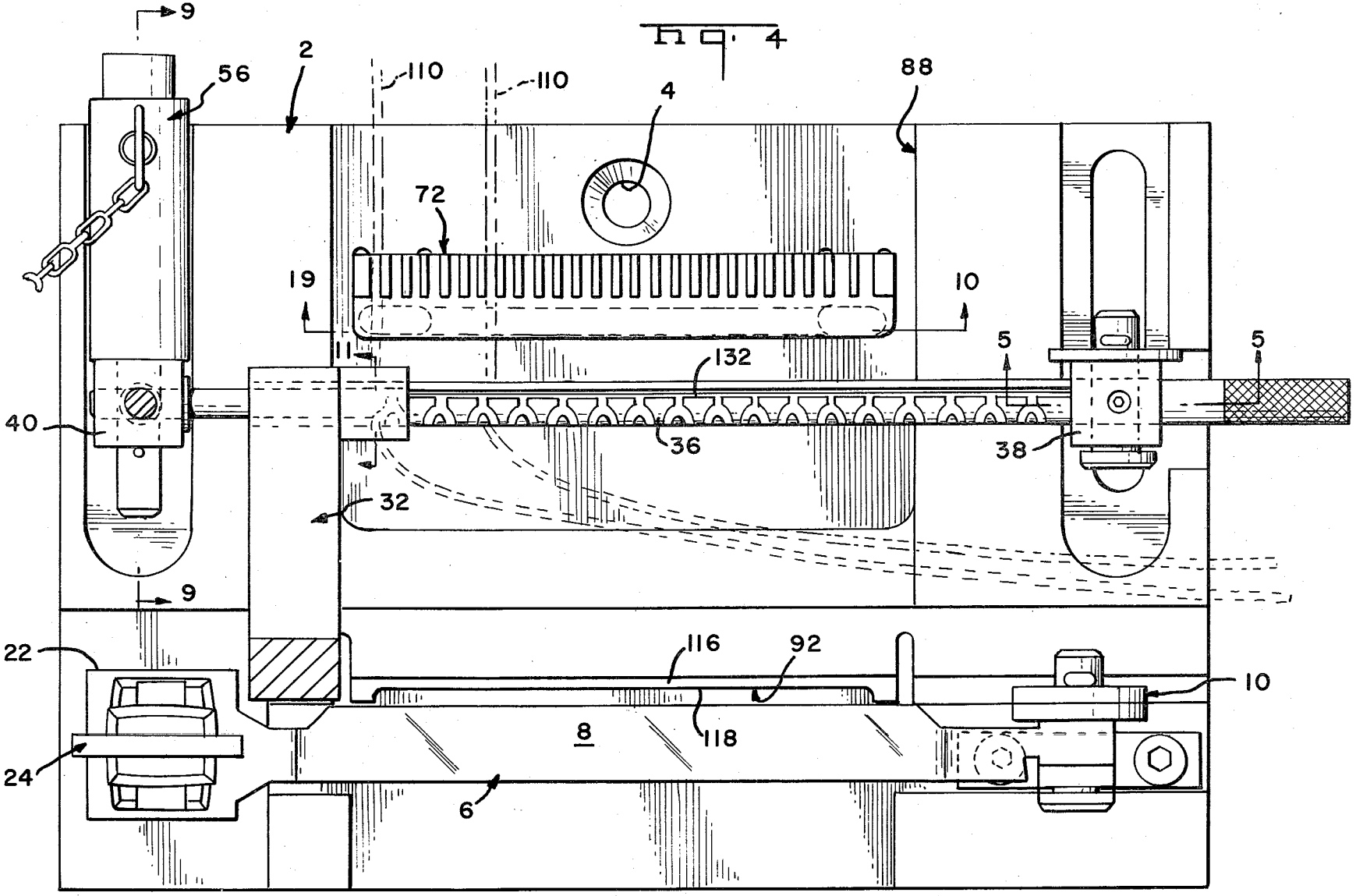
FIG. 4 is an enlarged top plan view of the apparatus shown in FIG. 1.

As shown more particularly in FIGS. 3 and 4, the platen 2 is provided with a relatively wide recessed channel 88 in the top surface thereof defining a bottom wall 90 in which the aperture 4 is drilled and in which the slot 84 and the recesses 82 are provided. Channel 88 is interrupted by a raised jig illustrated generally at 92 so constructed and arranged to hold an electrical connector. A typical electrical connector is shown more particularly in FIGS. 2 and 14. The details of the connector itself are described in U.S. Pat. No. 3,760,335, the connector being only briefly described herein. The connector is shown generally at 94 and includes a mating side 96 and a wire terminating or connecting side 98 separated by a central encircling flange 100. The connecting side is provided with a plurality of projecting partitions 102 which are spaced apart side to side and which have recesses 104 immediately adjacent to the flange 100. The connector further is provided with a plurality of electrical contacts illustrated generally at 106 and having formed wire-receiving and connecting portions 108 interlaid between partitions 102. The connector is provided with two oppositely projecting rows of partitions 102 and corresponding contact portions 108.

Figure 14:
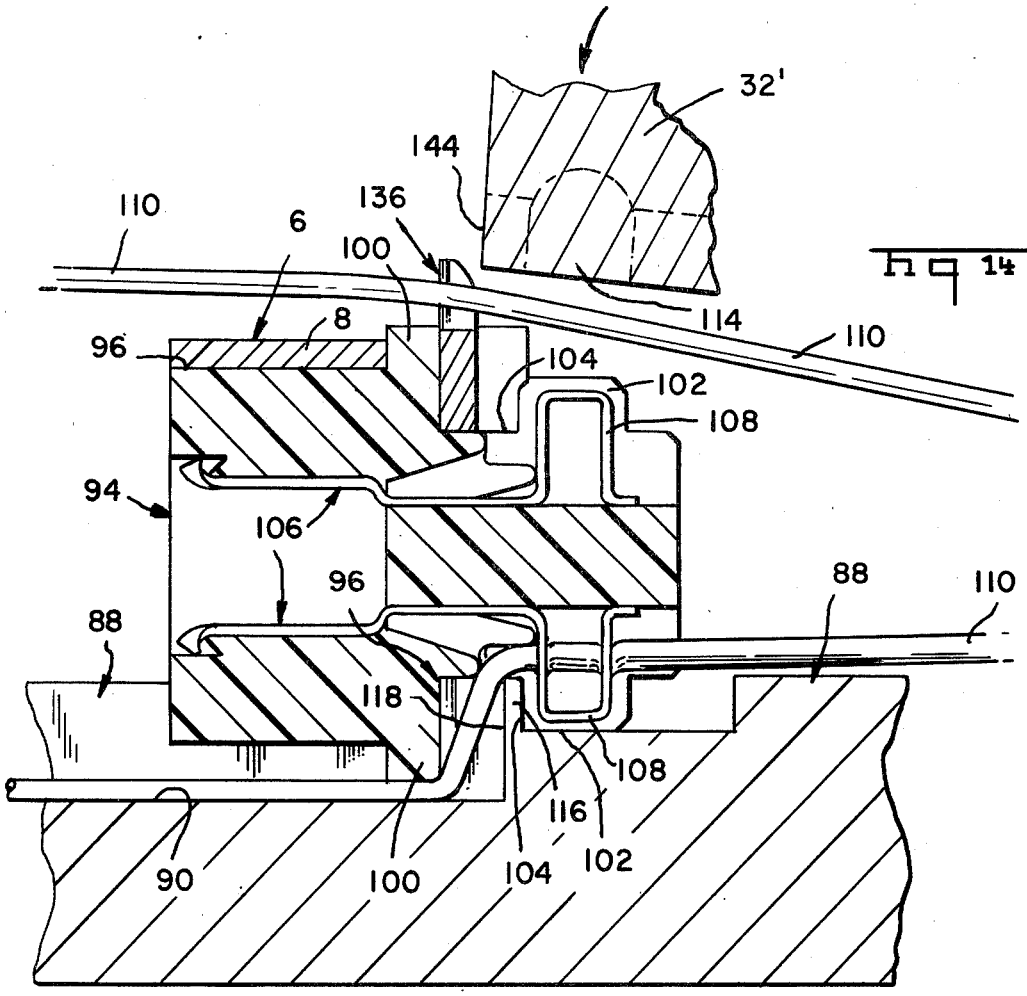
FIG. 14 is an enlarged side elevation in section of a portion of the tool according to the present invention illustrating insertion of the wire together with a cutter bar for severing the wires prior to insertion.

To mount the connector 94 to the platen reference is made to FIG. 14 taken in conjunction with FIGS. 3 and 4. The spring clamp 6 first is pivoted about the clevis 10 out of the way of the platen 92. The connector is mounted to the jig 92. Subsequently, the spring clamp 8 is pivoted to overlie the mating side 96 and the fastener 24 is secured in the aperture 30 upon proper rotation of the lever. Initially the shaft 36 is pivoted about the clevis 44 out of the way of the channel 88. The comb 72 is mounted in position. The platen 2 is properly located in position for receiving wires to be terminated in the connector mounted on the jig 92, for example, by securing the platen by a fastener through the aperture 4. Individual wires such as the ones illustrated at 110 are laced or interlaid between the comb teeth 74. The wires are gathered within the channel 88, the shaft 36 is pivoted to overlie the wires gathered in the channel 88. The fastening device 56 is secured to the mounting block 40 to secure the shaft in place. The wires then are gathered and their lengths routed under the shaft 36 and then laterally outward of the channel 88 parallel to the shaft 36 to lie lengthwise parallel in the space between the shaft 36 and the spring clamp 8. Thus as shown in phantom outline in FIG. 4 the wires are curved and disposed lengthwise parallel to the shaft 36. If the wires extend from left to right as shown in FIG. 4, then the first wire 110 interlaid at the far left hand side of the comb 72 is terminated or connected in the connector before the other wires 110. More particularly, the far left hand wire 110 is grasped and separated from the remainder of the wires 110. As shown in FIG. 14, the grasped wire then is straightened to overly the connector. The inserter 32 is indexed to a corresponding far left hand position on the shaft 36 which corresponds to the far left hand position of a first contact 108 in the connector. The far left hand wire 110 then is placed by an operator against the inserter. More particularly, as shown in FIGS. 6, 9, and 14, the end of the inserter which faces the connector is provided with a groove 112 adjacent to a narrow insertion blade 114. The wire 110 is positioned lengthwise in the groove 112 by an operator and the inserter 32 and the wire in the groove 112 are pivoted together toward the connector in the act of inserting the wire into a corresponding wire-receiving slot of the electrical contact 108. The blade portion 114 overlies the wire lengthwise and impinges the wire forcing it into the contact 108. The blade 114 is sufficiently narrow to enter the slot of the contact 108 to insure insertion of the wire at a sufficient depth within the contact.

Each successive wire 110 lead within the comb 72 is separated in turn from the remaining wires. The inserter 32 is indexed along the shaft 36 a distance corresponding to the spacing between adjacent contacts 108, such that each indexing is followed by an insertion operation until the required number or selection of wires in the comb 72 are connected to corresponding contact portions 108 in the connector 94. The spring clamp 6 and the shaft 36 are pivoted out of the way to allow removal of the connector from the platen. The connector then is inverted and reset on the jig 92 to provide an opposite row of empty contact portions 108 on the jig for connection of another group of wires in the connector. The first group of wires 110 which already have been connected in the connector thereby lie gathered in the channel 88. When the comb 72 is placed on the platen 2 the wires will be gathered in the clearance under the comb as shown in FIG. 10. The group of wires already connected to the connector also will underly the shaft 36, the wire clamp 6, and will also bridge over the jig 92 as shown in FIG. 14. More particularly, the wires 110 will overly a raised portion 116 of the jig 96, which portion 116 which enters the recesses 104 stabilizing the connector on the jig 96. A vertical channel 118 is provided in the raised jig portion 116 which allows the wires 110 already connected to the connector to lie within the clearance provided by the channel 118 adjacent to the flange 100. Additionally, the flange 100 is suspended above the bottom wall 90 of the channel 88 to provide a clearance and allow the connected wires 110 to pass by the flange and along the channel 88.

Figure 11:
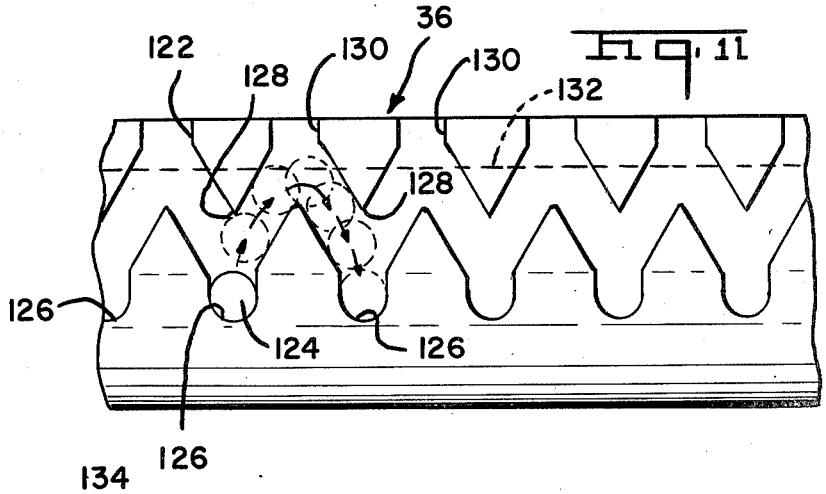
FIG. 11 is an enlarged fragmentary diagrammatic view of a portion of an indexing shaft or the apparatus.

The indexing mechanism for the inserter 32 is more particularly illustrated in FIG. 11. The shaft 36 is provided with a groove 122 configured in the series of inverted V configurations. A pin 124 provided in the pivot sleeve 34 is captivated for displacement with the groove 122. In the lower apeces 126 of the grooves, a pin 124 in registration therewith will locate the inserter on the shaft at positions corresponding to the row of contacts 108 in the connector 94. To index the pin 124 from one apex 126 to another the inserter may be pivoted manually by grasping the lever 33 with some sideways pressure in the direction parallel to the shaft to cause the pin 124 to be displaced along the inverted V configuration of the groove 122, as shown by the arrows in FIG. 11. During an insertion operation the pin may be raised out of an apex 126 until it engages an opposite apex 128. There is sufficient space between corresponding apeces 128 and 126 to allow for pivotal motion of the inserter in direct alignment with a corresponding position of a contact 108 without having to displace or traverse the pin 124 in a direction lengthwise of the shaft 36. The groove 122 further includes a series of groove portions 130 which bridge between the inverted V shaped groove portions to another groove section 132 which extends lengthwise of the shaft 36. In some cases it is desired to move the inserter along the shaft without indexing to each successive position along the V shaped groove portions. When this is desired, the pin 124 is displaced by pivoting the inserter 32 to traverse through one of the groove sections 130 until the pin is registered within the groove section 132. Once the pin 124 is in the groove section 132, the inserter 32 may be freely slid along the shaft 36 to any desired position.

Figure 12:
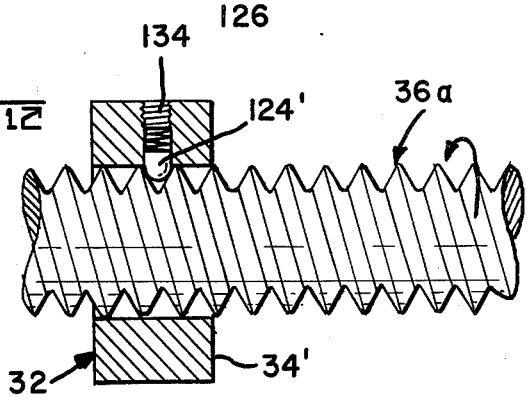
FIG. 12 is an enlarged fragmentary view of an alternative embodiment of a shaft according to the present invention.

FIG. 12 illustrates a modification of the shaft 36. In the Figure the modified shaft **36*a* is provided with a lead screw configuration having a pitch equal to the spacing between corresponding contacts 108 of the connector 94. The modified pivot 34' of the inserter 32 is provided with a bore 134 having a spring loaded pin 124' in registration with the threads of the lead screw configuration. On each revolution of the lead screw, for example, by manual rotation thereof, the pin will be advanced or indexed along the shaft 36*a* successively from one contact position to another. By exerting sufficient manual pressure on the pivot 34' in a direction axially of the lead screw configuration, the pin 124' will be forced to retract within the bore 134 allowing the inserter to slide along the shaft 36*a* with the pin 124' skipping over the threads thereof. In this manner, the inserter 32** may be displaced along the shaft without a need for indexing to each successive contact position.

Figure 2:
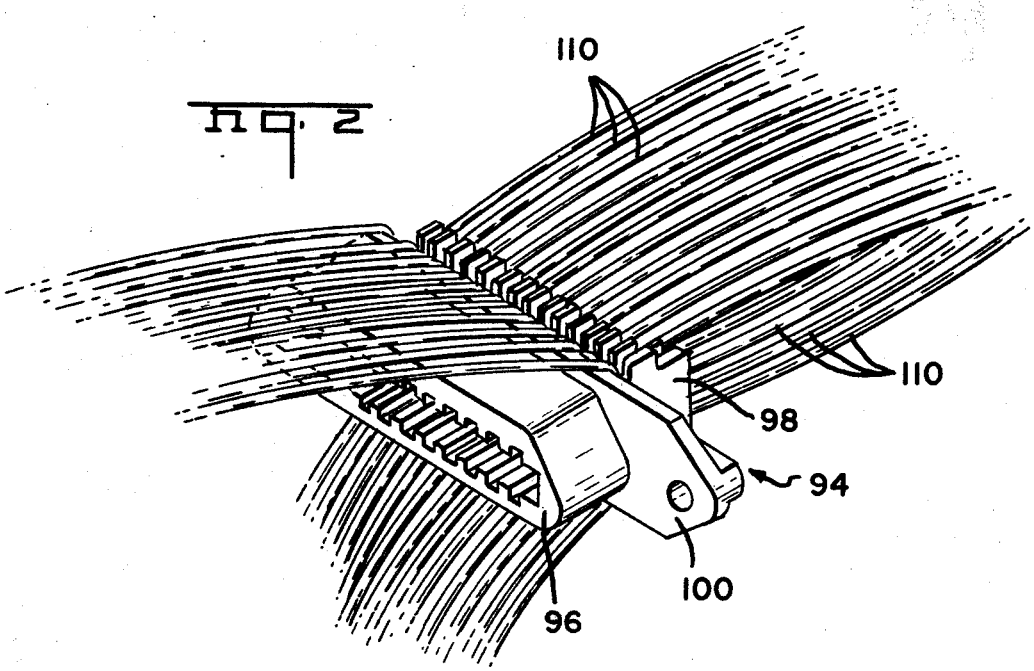
FIG. 2 is an enlarged fragmentary perspective of an assembly of multiple insulated wires connected to an electrical connector by utilizing the apparatus according to the present invention.
Figure 13:
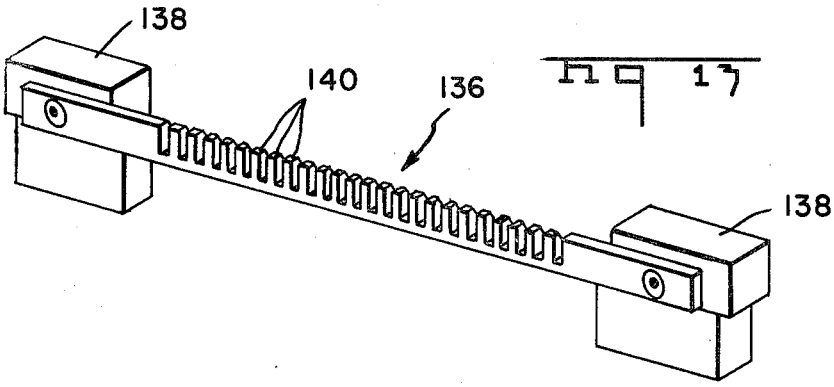
FIG. 13 is an enlarged perspective of a cutter bar.

Thus far described has been the assembly of unsevered wires into the connector 94, allowing two rows of unsevered wires into the connector assembly as shown in FIG. 2. Alternatively, it may be desired to sever a wire, in which case a cutter bar for the assembly is used and is shown in FIGS. 13 and 14. In FIG. 13 the cutter bar is illustrated generally at 136 in the form of a cutting blade. The cutter bar is secured on mounting blocks 138 at opposite ends thereof. The cutter bar further is provided with a series of teeth 140 forming a comb used in conjunction with the comb 72 when cutting of the wires during insertion is desired. As shown in the FIG. 14, the cutter bar 136 is mounted directly in the recess 104 and against the flange 100. The cutter bar mounting blocks 138 are press fit within a groove portion 142 provided in the platen. The mounting blocks 138 will impinge against the opposite ends of a connector mounted on the jig 96. As shown in FIG. 14, when a wire 110 is impinged against the inserter 32, and pivoted together with the inserter in the act of inserting the wire, a forward surface 144 of the inserter will cooperate with a side surface of the cutter blade 140 in a scissoring action to sever the wire 110 prior to insertion thereof into a corresponding contact 108. An operator of the apparatus may find it useful to pull on the wire and take up the slack of a wire 110 and seat the wire between the teeth of comb 140 during the act of insertion in order to positively retain the wire in position during severing thereof.

Figure 15:
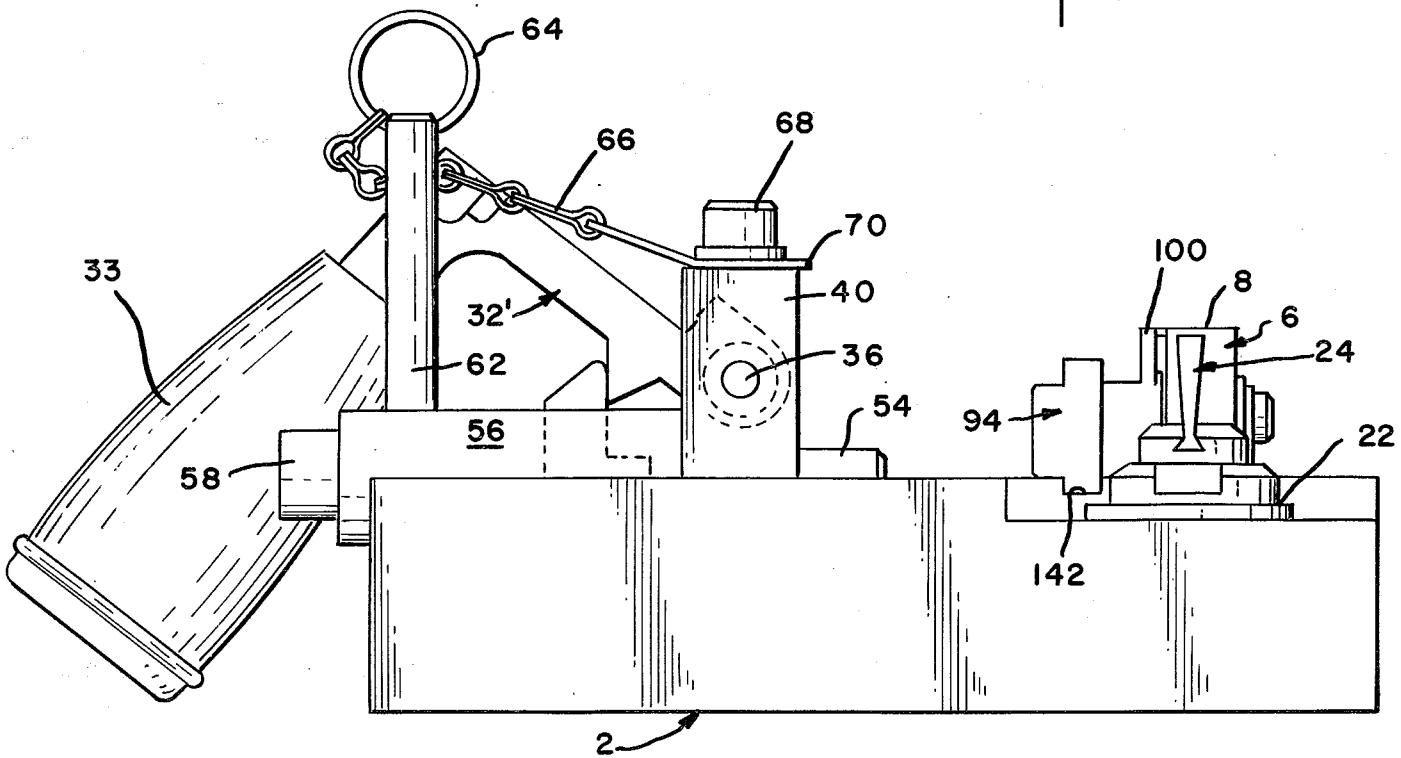
FIG. 15 is a side elevation illustrating a modified inserter.

FIG. 15 illustrates the inserter as having a wedge shaped projection 144 adjacent the pivot connection. When the inserter is pivoted out of the way of the connector, the projection 144 will impinge frictionally against the comb, serving as a keeper for holding the inserter out of the way, despite any orientation of the platen with respect to horizontal. The inserter is released by manually grasping the lever 33 and overriding the frictional retention on the comb.

Although preferred embodiments and modifications of the invention are described and illustrated in detail other modifications and embodiments which would be apparent to one having ordinary skill in the art are intended to be covered by the spirit and scope of the appended claims.

What is claimed is:

1. In a tool for connecting multiple wires into connectors having a platen on which is mounted a connector, a comb, a reciprocating inserter for inserting wires into contacts of a connector, and a shaft mounted parallel to a row of contacts in said connector, the improvement comprising:

said inserter having a pivot connection to said shaft, said inserter having a blade portion insertable into a single one of said contacts, a link extending from said pivot connection to said blade portion and extending between said shaft and a row of contacts in said connector, said inserter having a manually actuated lever for pivoting said link about said shaft for engaging said blade portion against a wire and forcibly inserting the engaged wire into a single one of said contacts, and means for indexing said inserter along said shaft a distance corresponding to the spacing between adjacent contacts in said row.

2. The structure as recited in claim 1, wherein, said tool is pivotable about the shaft into latched engagement on said comb.

3. The structure as recited in claim 1, wherein, said platen includes a wire-receiving channel extending under said comb, said shaft and said connector.

4. The structure as recited in claim 1, wherein, said shaft is pivotally attached at one end to said platen and latchably secured at an opposite end to said platen.

5. The structure as recited in claim 1, and further including:

a removable cutter bar having a blade mounted to said platen overlying said connector adjacent said row of contacts, said inserter having a portion for cooperating with said blade in a scissoring action to sever said wire during the act of inserting said wire in a corresponding contact.

* * * * *